United States Patent [19]

Fraser et al.

[11] 3,950,089

[45] Apr. 13, 1976

[54] COATED ROLL FOR MAGNETIC BRUSH DEVELOPMENT AND CLEANING SYSTEMS

[75] Inventors: Lawrence J. Fraser; Delmer G. Parker, both of Rochester; Joseph L. Scaletta, Henrietta, all of N.Y.

[73] Assignee: Xerox Corporation, Stamford, Conn.

[22] Filed: Feb. 24, 1975

[21] Appl. No.: 552,010

[52] U.S. Cl. ..... 355/3 DD; 15/1.5 R; 118/637; 355/15; 427/18

[51] Int. Cl.[2] ..... G03G 15/00

[58] Field of Search..... 355/3 DD, 15; 118/637; 427/18; 15/1.5

[56] References Cited

UNITED STATES PATENTS

| | | | |
|---|---|---|---|
| 3,246,629 | 4/1966 | Shelffo et al. | 427/18 X |
| 3,402,698 | 9/1968 | Koyima et al. | 427/18 X |
| 3,455,276 | 7/1969 | Anderson | 118/637 |
| 3,707,389 | 12/1972 | Maksymiak et al. | 118/637 X |
| 3,739,748 | 6/1973 | Rittler et al. | 355/3 DD |
| 3,884,572 | 5/1975 | Bacon et al. | 355/15 |

*Primary Examiner*—R. L. Moses

[57] ABSTRACT

To realize the advantages which sometimes attach to the use of electrically conductive carrier particles, the electrodes within development systems and cleaning systems for electrostatographic processors, such as xerographic copiers and duplicators, are coated or otherwise held in intimate contact with a sufficiently thick layer of material having a resistivity which is selected to prevent carrier caused short circuit events from producing irreversible damage and to localize the effects of such events. As a general rule, a 1–25 mil thick layer of a material having a resistivity in the range of $10^7$ – $10^9$ ohm·cm is adequate for that purpose.

13 Claims, 5 Drawing Figures

FIG. 3
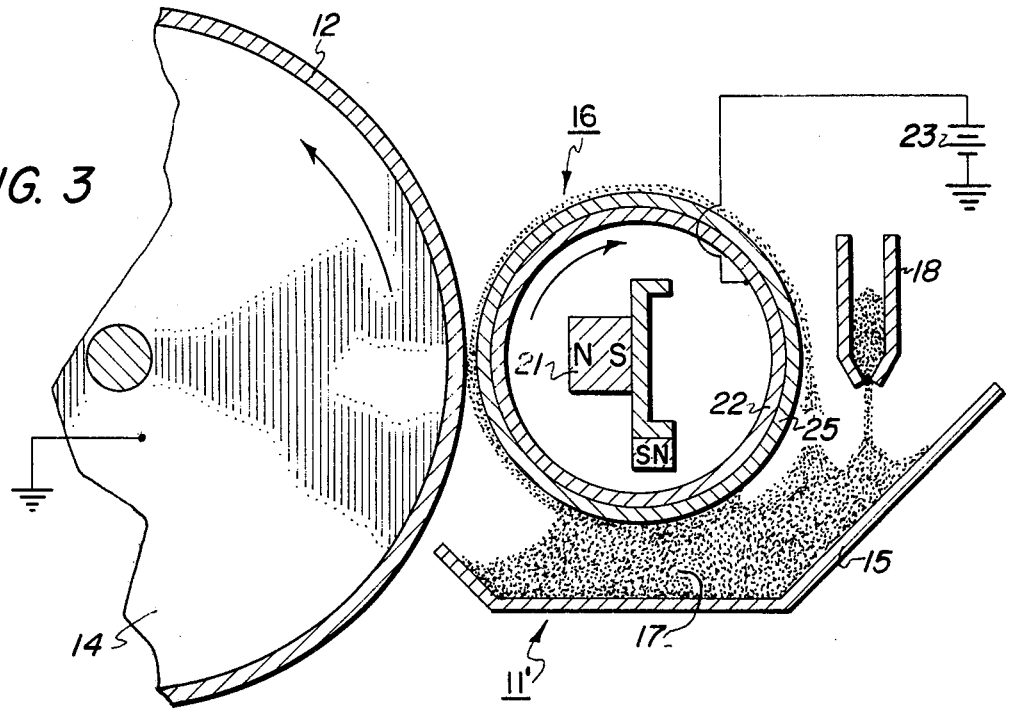
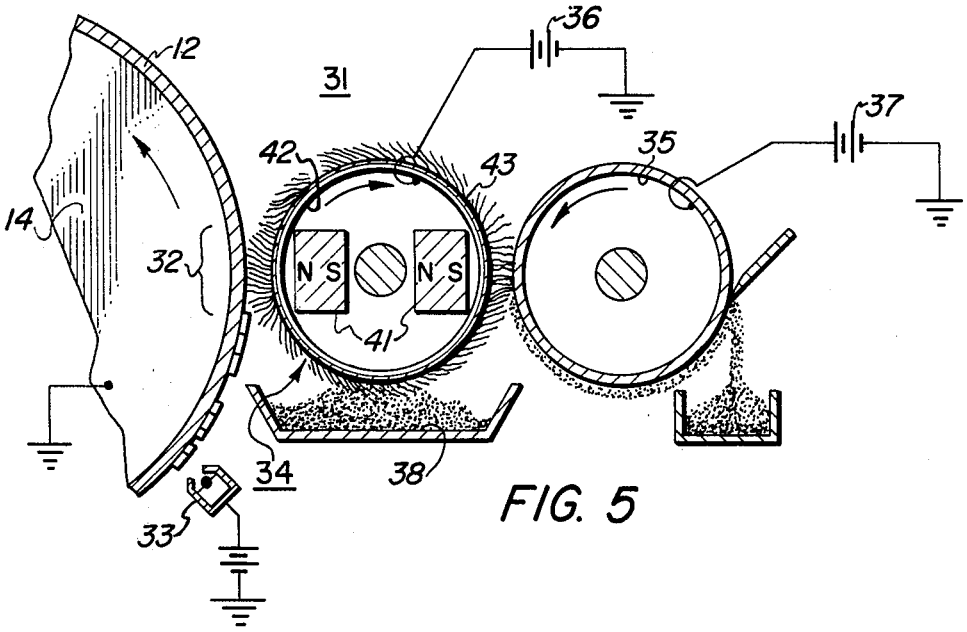
FIG. 5

COATED ROLL FOR MAGNETIC BRUSH DEVELOPMENT AND CLEANING SYSTEMS

BACKGROUND OF THE INVENTION

This invention relates to electrostatographic processors having development and/or cleaning systems which utilize electrically conductive carrier particles and, more particularly, to means for reducing the degrading effect of carrier caused short circuits on the performance of such systems.

In a conventional electrostatographic printing process of the type described in Carlson's U.S. Pat. No. 2,297,691 on "Electrophotography", a uniformly charged imaging surface is selectively discharged in an image configuration to provide a latent electrostatic image which is then developed through the application of a finely divided, coloring material, called "toner". As is known, that process may be carried out in either a transfer mode or a non-transfer mode. In the non-transfer mode, the imaging surface serves as the ultimate support for the printed image. In contrast, the transfer mode involves the additional steps of transferring the developed or toned image to a suitable substrate, such as a plain paper, and then preparing the imaging surface for re-use by removing any residual toner particles still adhering thereto.

The Carlson patent specifically relates to xerography, which is probably the best example of the outstanding commercial success of the foregoing process in view of the widespread use of xerographic copiers and duplicators. Xerography, of course, involves the use of a photoreceptor as the imaging surface. Thus, it should be understood that there are other types of electrostatographic processors. For example, there are processors wherein the imaging surface is a uniformly charged insulator which is selectively discharged non-photographically — e.g., by appropriately controlled stylii — to provide a latent electrostatic image which permits of subsequent processing in essentially the same manner as the photographically generated latent image of a xerographic processor. Moreover, it should be noted that xerographic and similar electrostatographic printing processes are not limited to use in stand alone copiers and duplicators. For instance, those processes have also been found to have utility in the facsimile art.

One of the preferred vehicles for delivering the toner needed for development purposes is a multi-component developer comprising a mixture of toner particles and larger, so-called "carrier" particles. Normally, advantage is taken of a triboelectric charging process to induce electrical charges of opposite polarities onto the toner and carrier particles. To that end, the materials for the toner and carrier (or, sometimes, carrier coating) components of the developer are customarily selected so that they are removed from each other in the triboelectric series. Furthermore, in making those selections, consideration is given to the relative triboelectric ranking of the materials in order to ensure that the polarity of the charge nominally imparted to the toner particles opposes the polarity of the latent images of interest. Consequently, in operation, there are competing electrostatic forces acting on the toner particles of such a developer. Specifically, there are forces which tend to at least initially attract the toner particles to the carrier particles. Additionally, the toner particles are subject to being electrostatically stripped from the carrier particles whenever they are brought into the immediate proximity of or actual contact with an imaging surface bearing a latent image.

It has also been found that toner starved carrier particles (i.e., carrier particles which are substantially free of toner) may be employed in cleaning systems to remove residual or other weakly adhering toner particles from an imaging surface. To enhance that type of cleaning, provision is desirably made for treating the unwanted toner particles with a pre-cleaning corona discharge which at least partially neutralizes the forces holding them on the imaging surface, and then the carrier particles are brought into contact with the imaging suface to collect the toner particles.

Basically, the imaging surface of a xerographic or similar electrostatographic processor is an electrically insulating member which is deposited on an electrically conductive backing. Frequently, the development and cleaning systems of such processors include one or more electrodes so that electrostatic fields which improve the performance of those systems may be locally generated by holding the backing for the imaging surface at one potential while biasing the electrode or electrodes to a different potential. For example, development systems commonly include a development electrode to gain improved solid area coverage, and the development electrode is usually biased to suppress background development.

Heretofore, problems have been encountered in attempting to use electrically conductive carrier particles in systems relying on locally generated electrostatic fields. In particular, experience has demonstrated that conductive carrier particles occassionally cause short circuits which are transitory (typically, having a duration of less than about 50 microseconds), but nevertheless troublesome inasmuch as they upset the fields. Proposals have been made to alleviate some of the problems, but the art is still seeking a complete solution. For example, it has been suggested that the development electrode and housing of a development system should be maintained at the same potential, thereby preventing any current flow therebetween even should conductive carrier particles bridge the intervening space. However, that suggestion does not solve the problem which arises when there is a pin hole or other defect in the insulating imaging surface which permits a bridge-like accumulation of carrier particles to establish a short circuit between the electrode and the conductive backing for the imaging surface.

Understandably, therefore, electrically conductive carrier particles are not generally favored. That is unfortunate because conductive materials, such as bare nickel and iron beads, are sometimes the best possible choice for the carrier component. Specifically, there is evidence indicating that electrically conductive carrier particles would not only prolong the useful life of some developer mixtures, but also reduce the background development levels and the edge deletions caused by certain development systems.

SUMMARY OF THE INVENTION

Accordingly, an object of this invention is to provide improved means for reducing the degrading effects of carrier caused short circuits on the performance of systems which rely on locally generated electrostatic fields while carrying out development or cleaning functions for electrostatographic processors. More particularly, an object is to provie development and cleaning systems of the foregoing type which are capable of substantially maintaining a predetermined level of performance, even in the face of carrier caused short circuits which terminate on the electrically conductive backing for the imaging surface of such a processor.

To carry out these and other objects of this invention, the electrode or electrodes of the development and/or cleaning systems of an electrostatagraphic processor are coated or otherwise maintained in intimate contact with an outer layer of resistive material which is selected to have sufficient resistivity and thickness to limit the energy dissipated during any carrier caused short circuit event to a predetermined, non-destructive, low level and to localize the effects of any such event.

BRIEF DESCRIPTION OF THE DRAWINGS

Still further objects and advantages of the present invention will become apparent when the following description is read in conjunction with the attached drawings, in which:

FIG. 3 is a simplified sectional view of a magnetic brush development system embodying this invention;

FIG. 5 is a simplified sectional view of a magnetic brush cleaning system embodying this invention.

DETAILED DESCRIPTION OF THE ILLUSTRATED EMBODIMENTS

While the invention is described in some detail hereinafter with specific reference to certain embodiments, it is to be understood that there is no intent to limit it to those embodiments. On the contrary, the aim is to cover all modifications, alternatives and equivalents falling within the spirit and scope of the invention as defined by the appended claims.

Figure 1:
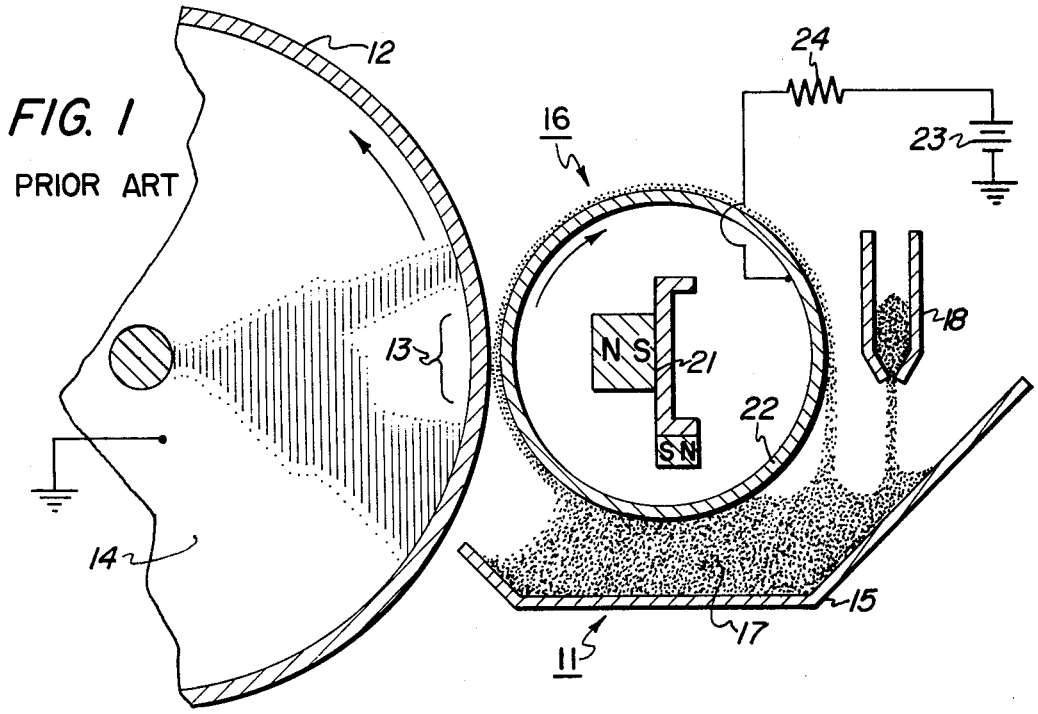
FIG. 1 PRIOR ART
FIG. 1 is a simplified sectional view of a more or less conventional magnetic brush development system.

Turning now to the drawings, and at this point especially to FIG. 1, it may be helpful to briefly review a simple magnetic brush development system 11. As is known, systems of that type have been successfully employed in electrostatographic processors to develop electrostatic latent images carried by an electrically insulative imaging surface 12 on the fly — viz., as the imaging surface advances through a development zone 13. Indeed, magnetic brush development has gained widespread popularity, particularly in the xerographic art. Thus, for illustrative purposes, attention will be focused on xerographic processors. That means that the imaging surface 12 may be assumed to be a photoreceptor which is coated or otherwise deposited on an electrically conductive backing 14. Specifically, non-transfer xerography generally involves the use of a sheet or web-like photoreceptor having an electrically conductive backing. Transfer xerography, on the other hand, is normally carried out with a photoreceptor which is coated on either a rotatable drum (as shown) or an advancable, flexible belt-like member.

As will be appreciated, magnetic brush development systems have become increasingly sophisticated as a result of a continuing emphasis on improved copy quality. Characteristically, however, such systems comprise a housing 15 containing one or more rotatably driven applicator rolls 16 which are spaced a predetermined short distance from the photoreceptor 12 to brush developer thereagainst. The developer, which usually includes toner particles and ferromagnetic carrier particles, circulates in a path which runs from a sump 17 in the lower reaches of the housing 15, through the development zone 13, and then back to the sump 17. Some toner is necessarily consummed in the development process and, therefore, there usually is a toner dispenser 18 for adding additional toner to the developer mixture from time-to-time so that its toner concentration remains at a suitably high level.

The principal purpose of the applicator roll or rolls 16 is to transport developer into and through the development zone 13 under the influence of a magnetic field which is shaped to cause the developer to form into bristlelike stacks or streamers which brush against the photoreceptor 12. Those bristles are pronounced only in a relatively narrow area more or less centered on the line along which the applicator roll 16 makes its closest approach to the photoreceptor 12. However, the applicator roll 16 carries magnetically entrained developer from a pick-up point located upstream of that area to a discharge point located downstream thereof. To that end, each applicator roll 16 typically comprises a stationary permanent magnet assembly 21 which is supported within a non-magnetic, rotatable sleeve 22. Normally, the outer surface of the sleeve 22 is flame sprayed or otherwise treated so that it has a sufficiently high coefficient of friction to effectively transport the developer.

Figure 2:
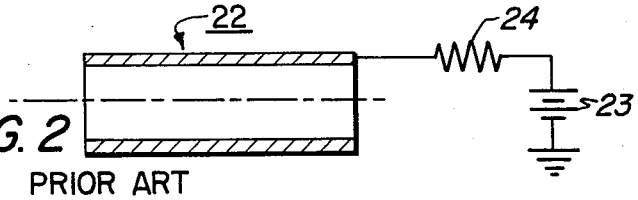
FIG. 2 PRIOR ART
FIG. 2 is an elementary electrical model of the development system shown in FIG. 1.

Referring additionally to FIG. 2, it is generally recognized that the sleeve 22 of the applicator roll 16 may also be used as a development electrode if it is formed from an electrically conductive material. Thus, there are existing magnetic brush development systems wherein the conductive substrate or drum 14 for the photoreceptor 12 is held at a reference potential, such as ground, while the sleeve 22 is biased to a different potential by a suitable bias supply, schematically represented by the battery 23. For example, if the image areas of the photoreceptor 12 are charged to about +800 volts and the background areas are charged to only about +200 volts, improved solid area coverage can be obtained while providing an acceptable low background development level by biasing the sleeve 22 to a potential of about +300 volts.

As previously mentioned, the performance of prior development systems containing development electrodes has not been altogether satisfactory when electrically conductive carrier particles have been used. The problem is that short circuits are occasionally created as a result of the conductive carrier particles bridging between the development electrode and nearby, non-equipotential surfaces. In some development systems, the housing 15 is such a surface. But, as a practical matter, the more troublesome aspects of the problem are associated with the potential short circuit paths which extend from the development electrode or sleeve 22, through pin holes or similar defects in the photoreceptor 12, to the conductive substrate or drum 14.

The generally accepted practice of inserting a current limiting resistor 24 in series with the bias supply 23 for the sleeve-like development electrode 22 is a safeguard which ensures that the energy dissipated during any short circuit event remains at a non-destructive level. More particularly, the energy dissipated is given by the formula:

$$E = \frac{V^2 t}{R} \quad (1)$$

where

V = the voltage dropped in the loop completed by the short circuit;

$t$ = the duration of the short circuit; and $R$ = the resistance across which the voltage V is dropped.

Carrier caused short circuits are transistory events which seldom if ever, persist for longer than about 50 microseconds. Moreover, it is unlikely that the voltage which must be dropped when such an event occurs will exceed the development electrode-to-photoreceptor substrate voltage difference of, say, 300 volts or so. Hence, a worst case analysis may be performed to calculate from equation (1) the current limiting resistance required to hold the energy dissipated during any carrier caused short circuit event to an acceptably low level — i.e., a level well below that which might lead to irreversible damage, such as localized heating of the photoreceptor 12 to its melting point. As a general rule, a current limiting resistor 24 having a resistance of approximately 1 megohm proves to be more than adequate.

As will be seen, the present invention provides an even more effective solution to the problems created by carrier caused short circuits. Briefly, the provision made in accordance with this invention not only limits the energy dissipated during any such short circuit even to an acceptably low, safe level, but also confines the accompanying disturbance of the electrostatic field to a localized portion of the field.

Figure 4:
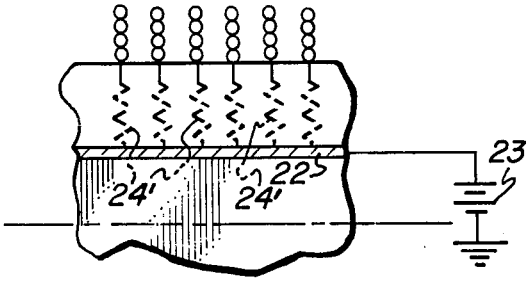
FIG. 4 is an elementary electrical model of the development system shown in FIG. 3.

More particularly, in keeping with the present invention, as illustrated in FIGS. 3 and 4, the outer surface of the sleeve-like development electrode is coated or otherwise held in intimate contact with a sheath 25 of high resistivity material. As will be appreciated, the coating 24 effectively inserts a separate current limiting resistance 24' in series with each of the potential short circuit paths extending from the sleeve 22. Consequently, the lumped current limiting resistance of the resistor 24 (FIGS. 1 and 2) may be eliminated. Otherwise, however, the improved development system 11' is sufficiently similar to the prior art development system 11 to justify the expediency of using like reference numerals to designate like parts.

The value of each of the distributed current limiting resistances 24' provided by the coating 25 can be determined, to at least or first approximation, from the formula:

$$R = \frac{L}{A} \quad (2)$$

where $R$ = the resistivity of the coating material;

$L$ = The thickness of the coating; and $A$ = The nominal cross-sectional area of each carrier particle.

As will be recalled, equation (1) can be used to calculate the resistance needed to limit the energy dissipated during each carrier caused short circuit event to a predetermined, non-destructive level. That resistance can then be used in equation (2), together with a predetermined nominal cross-sectional area for each carrier particles, to identify acceptable ranges for the resistivity and thickness of the electrode coating 25. As a general guideline, in a conventional development system utilizing spherical beadlike carrier particles having a nominal diameter on the order of 100 microns, a 1–25 mil thick coating of a material having a resistivity of $10^7 - 10^9$ ohm·cm is normally satisfactory. Indeed, it has been experimentally verified that a 25 mil thick coating of conductive rubber doped with carbon black to produce a resistivity of $10^8$ ohm·cm not only achieves the above-mentioned goals, but also has a sufficiently high coefficient of friction for use on the developer contacting surface of a magnetic brush applicator roll, such as the outer surface of the sleeve 22. The conductive rubber used was "Kraton 4119" (supplied by Shell Chemical Company, a Division of Shell Oil Company) and the carbon black was "Neospectra" (supplied by Columbina Carbon Company, a Division of City Service). The coating was applied by spraying.

Turning now to FIG. 5, it should be understood that the principles of this invention are also applicable to cleaning systems which utilize electrically conductive carrier particles in the presence of a locally generated electrostatic field. To illustrate that, the invention is shown as being embodied in an otherwise conventional magnetic brush cleaning system 31 which employs toner starved, ferromagnetic carrier particles to remove residual toner particles from the photoreceptor-type imaging surface 12 as that surface advances through a cleaning zone 32. Preferably, such a cleaning system is augmented by a pre-cleaning corona generating device 33 which is located just ahead of the cleaning zone 32.

In this instance, the cleaning system comprises a cleaning roll 34 and a purging roll 35. Those rolls are rotatably driven, as indicated by the arrows, and are biased by suitable supplies schematically depicted by the batteries 36 and 37, respectively, to cause the residual toner particles entering the cleaning zone 32 to transfer from the photoreceptor 12 to the toner starved carrier particles on the cleaning roll 34 and then to the purging roll 35.

More particularly, the cleaning roll 34 is spaced a predetermined, short distance from the photoreceptor 12 and is used to circulate toner starved carrier particles along a path which runs from a sump 38, through the cleaning zone 32, past the purging roll 35, and then back to the sump 38. The carrier particles in that path are under the influence of a magnetic field which is shaped to cause them to form bristle-like stacks or streamers as they move through the cleaning zone 32 and past the purging roll 35. To that end, the cleaning roll 34 suitably comprises a stationary permanent magnet assembly 41 which is supported within a non-magnetic, electrically conductive sleeve 42. The sleeve 42 is biased by the bias supply 36 so that its polarity opposes the polarity of the charge on the residual toner particles and so that there is a voltage drop of, say 1,000 volts or so, between it and substrate 14 for the photoreceptor 12. Thus, there is an electrostatic field between the substrate 14 and the sleeve 42, which supplements any triboelectric charging which may take place, to attract the residual toner particles from the photoreceptor 12 to the toner starved carrier particles magnetically entrained on the sleeve 42.

The purging roll 35 is also an electrically conductive member. It is separated by a narrow gap from the sleeve 42 of the cleaning roll 34 and is biased by the bias supply 37 so that there is an additional electrostatic field which causes the purging roll 35 to strip the toner particles from the carrier on the sleeve 42. A bias on the purging roll 35 of a few hundred volts relative to the bias on the sleeve 42 is ample to accomplish that, but the polarity of that voltage difference must be selected so that the toner particles are attracted from the sleeve 42 to the purging roll 35.

As will be seen, provision has been made in accordance with this invention to improve the performance of the cleaning system 31 when electrically conductive carrier particles are used therein. Specifically, the outer surface of the sleeve 42 of the cleaning roll 34 has a coating 43 which has a thickness and resistivity selected, as previously described, to localize the effects of carrier caused short circuit events and to prevent any such event from causing irreversible damage. Once again, a 1–25 mil thick coating of a material having a resistivity of $10^7 - 10^9$ ohm.cm will prove satisfactory for that purpose. To provide such a coating while achieving a sufficiently high coefficient of friction for use in a magnetic brush system, a mixture of conductive rubber and carbon black is again suggested.

CONCLUSION

In view of the foregoing, it will now be understood that this invention provides a very effective solution to the problems which have previously attached to the use of electrically conductive carrier particles in electrostatographic development and cleaning systems which rely on locally generated electrostatic fields. The electrode coating provided in accordance with this invention not only limits the energy dissipated during any carrier caused short circuit event to a predetermined non-destructive level, but also confines the effects of such an event to a localized portion of the field. Moreover, there is an electrode coating which will not only accomplish that, but which also has a sufficiently high coefficient of friction for use on the applicator rolls of magnetic brush-type development and cleaning systems.

Those interested in the more or less conventional details of the magnetic brush development and cleaning systems used to illustrate environments for this invention may refer to U.S. Pat. Nos. 3,176,652 and 3,580,673. Hence, those patents are hereby incorporated by reference. A so-called "with" mode is utilized by the development and cleaning systems shown here (i.e., the drum 14 is rotated in one direction while the applicator roll 16 (FIG. 3) and the cleaning roll 34 (FIG. 5) are rotated in the opposite direction), but it will be understood that either or both of those systems can operate in an "against" mode.

What is claimed is:

1. In an electrostatographic processor having an electrically insulating imaging surface with an electrically conductive backing; and a system including an electrode spaced from said imaging surface, means for creating a voltage drop between said electrode and said backing to generate an electrostatic field, and means for circulating electrically conductive carrier particles along a path passing through the space between said imaging surface and said electrode; the improvement comprising a substantially uniformly thick layer of resistive material in intimate contact with said electrode, the thickness of said layer and resistivity of said material being selected to limit the energy dissipated during any carrier caused short circuit event to a predetermined non-destructive level and to confine the effects of such an event on said field to a localized portion of said field.

2. The improvement of claim 1 wherein said system is a development system for developing latent electrostatic images carried by said imaging surface as said surface advances through a development zone, said electrode is a development electrode positioned adjacent said development zone to enhance and suppress development of solid image areas and background images areas, respectively, and said carrier particles are mixed with toner particles in a developer.

3. The improvement of claim 2 wherein said processor is xerographic, and said imaging surface is a photoreceptor.

4. The improvement of claim 2 wherein said resistive layer is about a1–25 mil thick coating on said electrode of a material having a resistivity of approximately $10^7 - 10^9$ ohm . cm.

5. The improvement of claim 4 wherein said carrier particles are ferromagnetic; said developer is circulated into and through said development zone by means including at least one applicator roll having a stationary permanent magnet assembly supported with an electrically conductive, rotatable, non-magnetic sleeve; and said sleeve is said electrode.

6. The improvement of claim 5 wherein the coating on said sleeve is a conductive rubber doped with carbon black and is selected to have a sufficiently high coefficient of friction to transport said developer in response to rotation of said sleeve.

7. The improvement of claim 6 wherein said processor is xerographic, and said imaging surface is a photoreceptor.

8. The improvement of claim 1 wherein said system is a cleaning system for removing residual toner particles from said imaging surface as said surface advances through a cleaning zone, said electrode is positioned adjacent said cleaning zone to attract toner particles from said imaging surface, and said carrier particles are circulated into and through said cleaning zone to collect said toner particles.

9. The improvement of claim 8 wherein said processor is xerographic, and said imaging surface is a photoreceptor.

10. The improvement of claim 8 wherein said resistive layer is about 1–25 mil thick coating on said electrode of a material having a resistivity of approximately $10^7 - 10^9$ ohm . cm.

11. The improvement of claim 10 wherein said carrier particles are ferromagnetic; said means for circulating said carrier particles includes a cleaning roll having a stationary permanent magnet assembly supported within an electrically conductive, rotatable, non-magnetic sleeve; and said sleeve is said electrode.

12. The improvement of claim 11 wherein the coating on said sleeve is a conductive rubber doped with carbon black and is selected to have a sufficiently high coefficient of friction to transport said carrier particles in response to rotation of said sleeve.

13. The improvement of claim 12 wherein said processor is xerographic, and said imaging surface is a photoreceptor.

* * * * *